US006970082B2

(12) United States Patent
Reese et al.

(10) Patent No.: US 6,970,082 B2
(45) Date of Patent: Nov. 29, 2005

(54) SYSTEM AND METHOD OF COMMUNICATING HOME SECURITY DATA BETWEEN A VEHICLE AND A HOME

(75) Inventors: Dian H. Reese, Holland, MI (US); Eric S. Deuel, Allendale, MI (US)

(73) Assignee: Johnson Controls Technology Company, Holland, MI (US)

( * ) Notice: Subject to any disclaimer, the term of this patent is extended or adjusted under 35 U.S.C. 154(b) by 0 days.

(21) Appl. No.: 10/206,437

(22) Filed: Jul. 29, 2002

(65) Prior Publication Data

US 2004/0017292 A1 Jan. 29, 2004

(51) Int. Cl.[7] ..... G08B 13/00
(52) U.S. Cl. ..... 340/541; 340/565; 340/5.3
(58) Field of Search ..... 340/541, 545.3, 340/550, 561, 565, 5.2, 5.3, 539.11, 539.17, 340/505, 425.5, 10.1

(56) References Cited

U.S. PATENT DOCUMENTS

| | | | | |
|---|---|---|---|---|
| 3,824,469 | A | | 7/1974 | Ristenbatt |
| 4,260,983 | A | | 4/1981 | Falck et al. |
| 4,353,064 | A | | 10/1982 | Stamm |
| 4,399,437 | A | | 8/1983 | Falck et al. |
| 4,476,469 | A | | 10/1984 | Lander |
| 4,514,731 | A | | 4/1985 | Falck et al. |
| 4,688,026 | A | | 8/1987 | Scribner et al. |
| 4,712,103 | A | | 12/1987 | Gotanda |
| 4,754,255 | A | | 6/1988 | Sanders et al. |
| 4,922,261 | A | | 5/1990 | O'Farrell |
| 5,049,867 | A | | 9/1991 | Stouffer |
| 5,227,779 | A | | 7/1993 | Falck |
| 5,310,999 | A | | 5/1994 | Claus et al. |
| 5,317,309 | A | | 5/1994 | Vercellotti et al. |
| 5,319,364 | A | | 6/1994 | Waraksa et al. |
| 5,351,187 | A | | 9/1994 | Hassett |
| 5,379,453 | A | | 1/1995 | Tigwell |
| 5,442,340 | A | | 8/1995 | Dykema |
| 5,479,155 | A | | 12/1995 | Zeinstra et al. |
| 5,564,101 | A | | 10/1996 | Eisfeld et al. |
| 5,565,843 | A | * | 10/1996 | Meyvis ..... 340/691.6 |
| 5,583,485 | A | | 12/1996 | Van Lente et al. ..... 340/525 |
| 5,614,885 | A | | 3/1997 | Van Lente et al. |
| 5,614,891 | A | | 3/1997 | Zeinstra et al. ..... 340/825.22 |
| 5,619,190 | A | | 4/1997 | Duckworth et al. |
| 5,627,529 | A | | 5/1997 | Duckworth et al. |
| 5,646,701 | A | | 7/1997 | Duckworth et al. |
| 5,661,651 | A | | 8/1997 | Geschke et al. |
| 5,661,804 | A | * | 8/1997 | Dykema et al. ..... 380/21 |
| 5,680,263 | A | | 10/1997 | Zimmermann et al. |

(Continued)

FOREIGN PATENT DOCUMENTS

DE 4323144 A1 1/1995

(Continued)

OTHER PUBLICATIONS

TRW's Integrated Overhead Console Provides Automakers, Consumers With a Bundle of Key Convenience, Security, Safety Features, printed from Internet address: http://www.findarticles.com/c.../articles.jhtml?term=TRW+%27s+ Integrated+ Overhead+Consol on Apr. 12, 2002, 2 pages.

(Continued)

*Primary Examiner*—Toan N. Pham
(74) *Attorney, Agent, or Firm*—Foley & Lardner LLP

(57) ABSTRACT

A system for communicating home security data between a vehicle having a vehicle element and a home comprising an interface coupled to the vehicle element configured to establish a communication link with a home security system and a processing circuit configured to receive home security data from the home security system.

30 Claims, 4 Drawing Sheets

U.S. PATENT DOCUMENTS

| | | | | |
|---|---|---|---|---|
| 5,686,903 | A | 11/1997 | Duckworth et al. | 340/825.22 |
| 5,699,054 | A | 12/1997 | Duckworth | 340/825.22 |
| 5,699,055 | A | 12/1997 | Dykema et al. | 340/825.22 |
| 5,732,074 | A | 3/1998 | Spaur et al. | |
| 5,745,849 | A * | 4/1998 | Britton | 455/404.1 |
| 5,854,593 | A | 12/1998 | Dykema et al. | 340/825.22 |
| 5,870,020 | A * | 2/1999 | Harrison, Jr. | 340/426 |
| 5,877,683 | A * | 3/1999 | Sheasley | 340/506 |
| 5,889,472 | A | 3/1999 | Nagel et al. | |
| 5,926,087 | A | 7/1999 | Busch et al. | 340/438 |
| 5,940,000 | A | 8/1999 | Dykema | 340/825.22 |
| 5,940,510 | A | 8/1999 | Curry et al. | |
| 6,069,588 | A | 5/2000 | O'Neill, Jr. | |
| 6,127,922 | A * | 10/2000 | Roddy et al. | 340/426 |
| 6,131,019 | A | 10/2000 | King | 455/99 |
| 6,154,148 | A | 11/2000 | Fluharty et al. | 340/7.1 |
| 6,215,449 | B1 | 4/2001 | O'Neill, Jr. | |
| 6,255,936 | B1 * | 7/2001 | Amato | 340/7.5 |
| 6,282,152 | B1 | 8/2001 | Kurple | 368/10 |
| 6,285,757 | B1 | 9/2001 | Carroll et al. | |
| 6,385,772 | B1 | 5/2002 | Courtney | |
| 6,400,265 | B1 | 6/2002 | Saylor et al. | |
| 6,424,888 | B1 * | 7/2002 | Sone et al. | 701/1 |
| 6,433,683 | B1 * | 8/2002 | Robinson | 340/540 |
| 6,448,894 | B1 * | 9/2002 | Desai | 340/505 |
| 6,449,472 | B1 * | 9/2002 | Dixit et al. | 455/404.1 |
| 6,593,856 | B1 * | 7/2003 | Madau | 340/825.69 |
| 6,661,350 | B1 * | 12/2003 | Rohrberg et al. | 340/825.69 |
| 6,693,530 | B1 * | 2/2004 | Dowens et al. | 340/506 |
| 2002/0013730 | A1 | 1/2002 | Bigus | |

FOREIGN PATENT DOCUMENTS

| | | | |
|---|---|---|---|
| DE | 19728083 | A1 | 2/1999 |
| DE | 19854047 | A1 | 5/2000 |
| EP | 1 261 150 | A1 | 11/2002 |
| WO | WO 94/02920 | | 2/1994 |
| WO | WO 98/25248 | A1 | 6/1998 |
| WO | WO 00/17021 | | 3/2000 |
| WO | WO 02/23502 | A1 | 3/2002 |

OTHER PUBLICATIONS

TRW's Universal Home Access System with Two-way Communication Offers Consumers Convenience and Peace of Mind, printed from Internet address: http://www.findarticles.com/cf_0/m4PRN/1.../article.jhtml?term=TRW+%26+universal+acces on Apr. 12, 2002, 2 pages.

Atmel Simplifies Design-in Process with Introduction of New Easy-to-Use Transparent RF ASK Receiver for Wireless Data Control Applications, printed from Internet address: http://library.northernlight.com/FC20020326280000126.html?cb=0&dx=1014&sc=0 on Apr. 12, 2002, 2 pages.

X10's ActiveHome Deluxe Kit, printed from Internet address: http://www.ideafinder.com/showcase/products/plp0286.htm on Apr. 16, 2002, 2 pages.

Briody et al., "Intel to launch wireless initiative", Infoworld, May 18, 1998, 2 pgs.

Haartsen, "Bluetooth—The universal radio interface for ad hoc, wireless connectivity", Ericsson Review No. 3, 1998, pp. 110-117.

Arfwedson et al., "Ericsson's Bluetooth modules," Ericsson Review No. 4, 1999, pp. 198-205.

International Search Report; International Application No. PCT/US/03/23516; mailed Nov. 12, 2003.

U.S. Appl. No. 06/419,451, filed Oct. 13, 2002, Entitled System and Method for Receiving A Wireless Status Signal in a Vehicle From a Remote Electronic System (11 Pages) (4 Sheets of Drawings).

"Touch the Future", 'Automatic Identification' by Dallas Semiconductor (12 pgs.).

* cited by examiner

SYSTEM AND METHOD OF COMMUNICATING HOME SECURITY DATA BETWEEN A VEHICLE AND A HOME

FIELD OF INVENTION

This invention relates generally to the field of a system, method, and apparatus for communicating information between a vehicle and a home, and more particularly, a system, method, and apparatus for communicating home security data between a vehicle and a home.

BACKGROUND OF THE INVENTION

Home security systems are becoming more and more common in the interest of heightened security and awareness. People feel comfort and security in knowing that their home is electronically armed and monitored by professional security services or agencies.

Wireless security and control systems are included as features in many products. For example, homes often have security systems which allow an operator to control the security system with a wireless transmitter by inputting a control command from the vehicle to control the home security system. The operator, for example, employs a wireless transmitter to activate or to deactivate a security and control system in their home.

Currently, there is a need for a system for communicating information and data back and forth in a two-way stream between the vehicle and the home security system. Such a system would improve the level of communication permitted between a vehicle and a home.

One disadvantage of existing home security systems is that, upon arriving home in a vehicle, a homeowner may not be aware of an unsafe condition in the home (e.g., a burglary or a fire), and may walk into the unsafe environment.

Therefore, there is a need for providing a system in which data can be received at a vehicle from a home security system. Further, there is a need for a system in which data can be transmitted from the vehicle to the home and from the home to the vehicle. There is a further need for controlling the data being transmitted from the home to the vehicle by some type of input mechanism.

SUMMARY

One embodiment of the present invention is a system for communicating home security data between a vehicle having a vehicle interior element and a home. The system comprises an interface coupled to the vehicle interior element configured to establish a communication link with a home security system, and a processing circuit configured to receive home security data from the home security system.

Another embodiment of the present invention is a method of communicating home security data between a vehicle and a home. The method comprises the steps of transmitting a request for home security data from an electronic module in a vehicle to a home security system, receiving home security data from the home security system in response to the transmitted request, and providing the home security data to an operator interface.

Yet another embodiment of the present invention is an apparatus for communicating home security data between a vehicle and a home. The apparatus comprises a means for transmitting a request for home security data from an electronic module in a vehicle to a home security system, a means for receiving home security data from the home security system in response to the transmitted request, and a means for providing the home security data to an operator interface.

BRIEF DESCRIPTION OF THE DRAWINGS

The features of the invention which are believed to be novel are set forth with particularity in the claims. The invention, together with further objects and advantages thereof, may best be understood by making reference to the following description taken in conjunction with the accompanying drawings, in the several figures of which like reference numerals identify identical elements, and wherein:

DETAILED DESCRIPTION OF EXEMPLARY EMBODIMENTS

Figure 1:
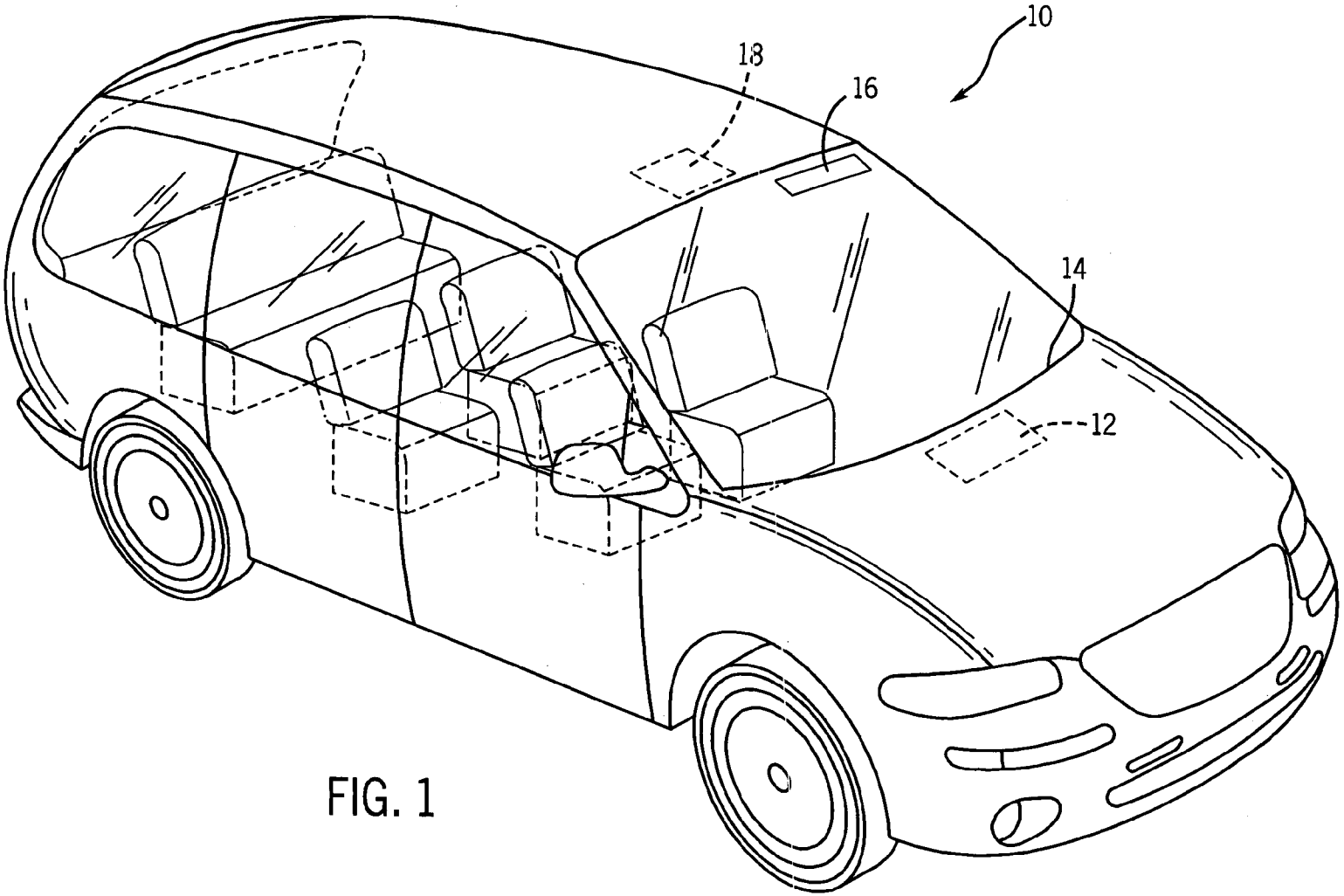
FIG. 1 is a diagram illustrating a vehicle having a system for communicating data to a home, according to an exemplary embodiment.

FIG. 1 discloses a vehicle 10 having a system 12 for communicating home security data between a vehicle and a home, according to an exemplary embodiment. FIG. 1 illustrates system 12, or one or more components of system 12, coupled to a vehicle interior element of vehicle 10, such as, an instrument panel 14, a visor 16, an overhead console 18, or another vehicle interior element, such as a steering wheel or a windshield. Vehicle 10 can be any type of automotive vehicle, construction vehicle, military vehicle, etc. In this exemplary embodiment, vehicle 10 is a minivan.

Figure 2:
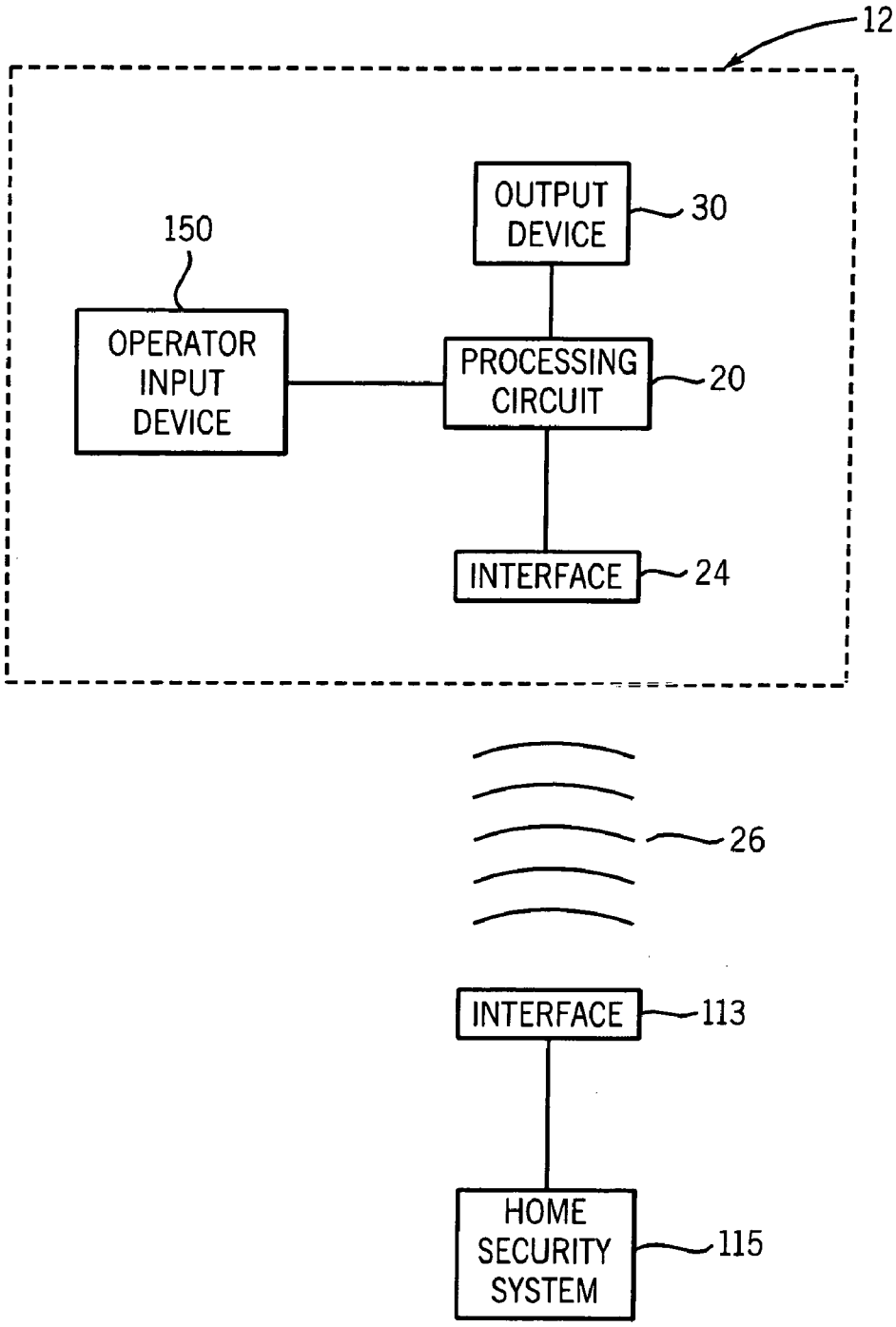
FIG. 2 is a functional block diagram illustrating details of the system shown in FIG. 1, according to an exemplary embodiment.

Referring now to FIG. 2, system 12 is illustrated in block diagram form. System 12 includes an interface 24 and a processing circuit 20. In this embodiment, system 12 is coupled to an instrumental panel 14 of vehicle 10. However, the vehicle interior element may be the overhead console 18, the visor 16, the instrument panel 14, or any other vehicle interior element within the interior of the vehicle 10. In alternative embodiments, one or more of the interface 24 and processing circuit 20 may be coupled to different vehicle interior elements within the interior of vehicle 10 or to other vehicle elements, such as, exterior elements (e.g., bumper, hood, etc.).

Processing circuit 20 includes analog and/or digital circuitry, and may include a microprocessor, microcontroller, application-specific integrated circuit (ASIC), or other, control circuitry. In this embodiment, processing circuit 20 is configured to receive home security data or information from home security system 115 via an interface 24 and to provide the data to an occupant of the vehicle via an output device 30 (e.g., a display, a speaker, a DVD player, etc.). Processing circuit 20 is also configured to transmit data or information from the interface 24 to home security system 115 via an interface 113 coupled to home security system 115. Processing circuit 20 is configured to transmit and/or receive wired or wireless data via interface 24 in any of a variety of data transmission formats or mediums, such as a Bluetooth™ communications protocol, an IEEE 802.11b communications protocol, an IrDA communications protocol (Infrared Data Association) or other wired or wireless communications protocols or data formats. Processing circuit 20 is configured to receive data and to transmit data. Interfaces 24 and 113 include hardware and/or software components configured for transmission of data over a wired or wireless interface via any suitable communication standard.

System 12 can further include an operator input device 150, which can be a button, switch, dial, touch sensor, voice recognition receiver, or other operator input device. In this exemplary embodiment, operator input device 150 includes a plurality of buttons coupled to the vehicle interior. Processing circuit 20 is configured to respond to inputs from operator input device 150 and to receive inputs from home security system 115 via interfaces 24 and 113. Operator input device 150 permits the operator to arm and disarm (enable/disable) the home security system or any other device coupled to a home networking system, check various secured zones, contact emergency officials, etc.

According to one embodiment, system 12 is configured to transmit a control message to home security system 115. The control message is a data message (e.g., which may be encoded) which is configured to enable and disable home security system 115. The control message is transmitted in response to operator actuation of operator input device 150.

Interface 24 is coupled to a vehicle interior element in this exemplary embodiment, and is configured to establish a communication link 26 with home security system 115 via interface 113. Communication link 26 is illustrated as a wireless connection in this exemplary embodiment, which can be an infrared or radio frequency communication link.

According to one alternative embodiment, output device 30 can be a speaker or other audio output device coupled to a vehicle interior element, and the data received from home security system 115 can be audio data that is played via the speaker. In another embodiment, audible and/or visible data can be displayed via output device 30.

According to another alternative embodiment, vehicle 10 may have a visual display such as a television screen, display, or other video output. The data received from home security system 115 can be visual data played via a display or a DVD system.

Figure 3:
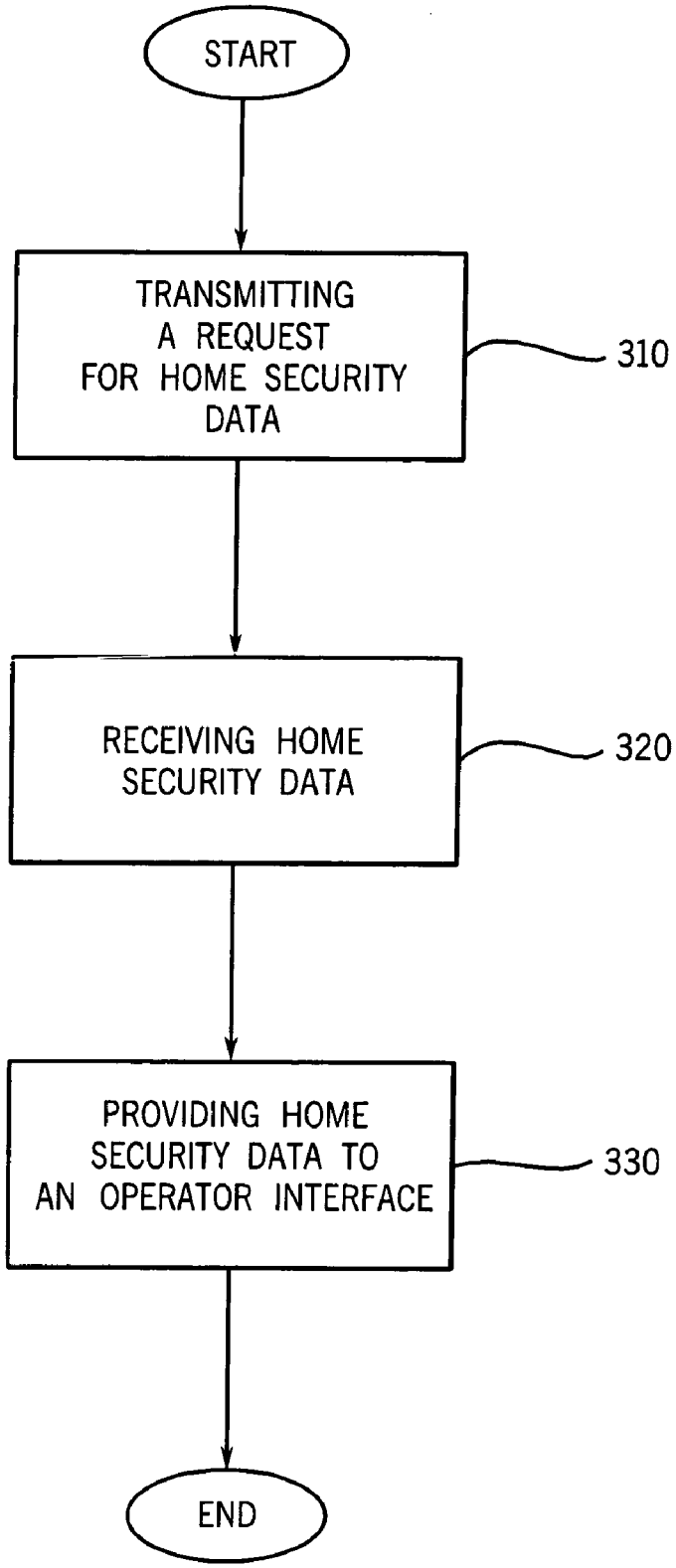
FIG. 3 is a flow diagram illustrating a method according to an exemplary embodiment.

FIG. 3 is a flow diagram illustrating a method according to an exemplary embodiment of the present invention. At step 310, a request for home security data is transmitted from an electronic module in a vehicle to a home security system. The electronic module is coupled to a vehicle interior element and includes processing circuit 20. The request from the module may be transmitted in response to operator actuation of an operator input device. The request may also be a control message configured to enable and disable the home security system. Further, processing circuit 20 can be configured to transmit a voice or data message to emergency personnel (e.g., police, security agency, "911" system, fire department, etc.) in response to operator actuation of a "panic" or other transmit button. At step 320, the home security data is received from home security system 115 in response to the transmitted request. The home security data is provided to output device 30, at step 330. The provided home security data can be audio, video, data or both.

The transmission of home security data between the vehicle and the home security system can be a wireless communication link and can be one-way or two-way. In addition, the home security data may include video data representative of a video image of an area of the home. In this situation, the operator interface includes a display configured to display the video data to a vehicle occupant. Home security system 115 is equipped with video cameras or any other type of visual recording devices.

Figure 4:
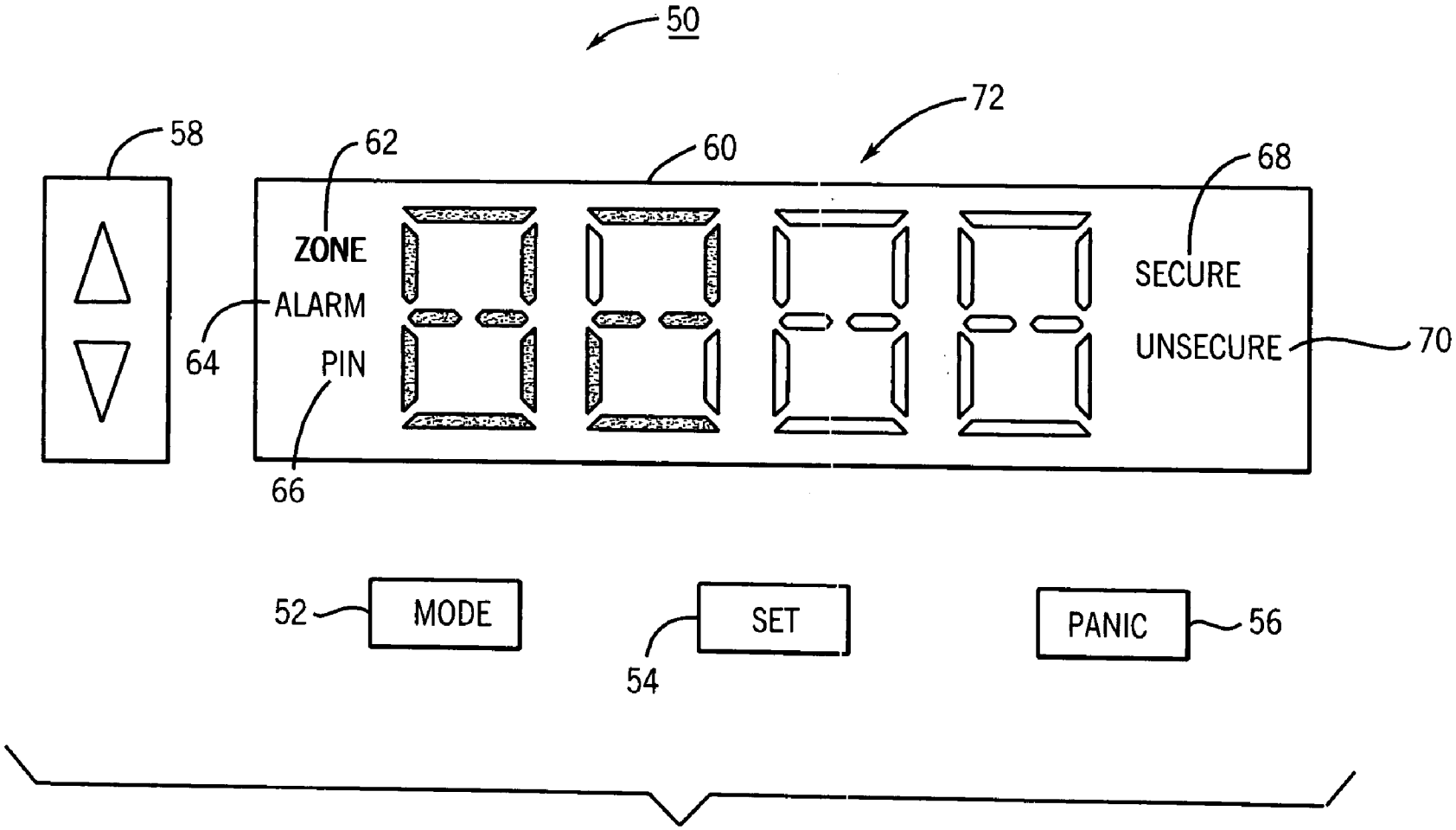
FIG. 4 is a front view of an operator interface, according to an exemplary embodiment.

Referring now to FIG. 4, an exemplary operator interface 50 comprising operator input devices and an output device is disclosed. Operator input devices include a mode button 52, a set button 54, a panic button 56, and a scroll button 58. Buttons 52–58 may alternatively be other types of operator input devices, such as, switches, voice recognition, touch screen interface, etc. Operator interface 50 further comprises a display 60, illustrated as a vacuum florescent display (VFD), which may alternatively be a light emitting diode (LED) display, liquid crystal display (LCD), or display using other technology. Display 60 includes a zone icon 62, an alarm icon 64, a PIN icon 66, a secure icon 68, and an unsecure icon 70. Display 60 further includes four eleven-segment displays 72 configured to display letters and numerals.

In operation, the operator actuates mode button 52, which sends a signal to processing circuit 20 to adjust the mode of system 12. System 12 can be placed into a zone mode, an alarm mode, or a PIN mode, and processing circuit 20 actuates one of icons 62–66 to indicate to the operator the mode which has been selected.

When in the "zone" mode, system 12 is configured to display home security data received from a home security system to an operator for one or more zones within the home. In this example, system 12 displays zone A2, indicating that zone A2 of the house is secure by illuminating secure icon 68. In response to operator actuation of scroll button 58 either upward or downward, system 12 scrolls through zone data for a plurality of zones in the home, displaying whether each zone is secure or unsecure using secure icon 68 and unsecure icon 70.

In the "alarm" mode, system 12 provides home security data indicating any unsecure conditions in the home, by displaying the appropriate zone and illuminating the unsecure icon 70. This indication instructs the operator that the alarm has been tripped and instructs the operator which zone of the home is unsecure. In this exemplary embodiment, when the alarm is tripped, unsecure icon 70 flashes.

At any time, and during any mode, the operator can press panic button 56 to immediately transmit a request for assistance to emergency personnel. The information can be transmitted to home security system 115 in order to contact emergency personnel, or the request for assistance can be transmitted directly from system 12 to emergency personnel.

In this exemplary embodiment, a personal identification number (PIN) is required before system 12 can be used to turn home security system 115 on or off. Accordingly, an operator can input a PIN using scroll button 58 and some combination of buttons 52, 54, and 56, and can then send the PIN to home security system 115 by pressing set button 54. Once home security system 115 recognizes a PIN, the operator can then enable or disable home security system 115 by using set button 54 or some other combination of buttons. When mode button 52 is used to put system 12 in PIN mode, system 12 illuminates PIN icon 66. In this exemplary embodiment, when in PIN mode, system 12 is also in alarm mode 64, and, therefore, alarm icon 64 is illuminated simultaneously with PIN icon 66.

According to one advantage of the exemplary system disclosed in FIG. 4, once an operator arrives at their home in the vehicle, and the alarm has been tripped, but the police have not yet arrived, system 12 enables the operator to check the status of all home security zones from the safety of the vehicle. The operator can check the status of the home security zones and whether the alarm was tripped. Further-more, if the home security system includes security cameras, the cameras could transmit data to system 12 for display via a video system, such as a DVD system, and the operator can observe activities within the house from the safety of the vehicle.

According to another exemplary embodiment, system 12 can be configured as a trainable transceiver, such as that disclosed in U.S. Pat. No. 5,903,226, which is herein incorporated by reference. In this embodiment, system 12 is configured to receive or generate format data, which can include a frequency and a data code, representative of a wireless transmission format associated with home security system 115. In this embodiment, system 12 is configured to learn the format data by any of a number of methods, such as, by operator selection of one of a plurality of pre-stored or predetermined data formats stored in system 12, or by receiving a signal transmitted by home security system 115 at interface 24 and learning the data format based on the received signal. Once a data format associated with home security system 115 is provided to system 12, system 12 is configured to transmit and receive data with home security system 115 using the provided format data.

Other exemplary embodiments are apparent to those skilled in the art from a consideration of the specification and the practice of the invention disclosed therein. It is intended that the specification be considered as exemplary only with the true scope of the invention being indicated by the following claims.

What is claimed is:

1. A system for communicating home security data between a vehicle having a vehicle element and a home, the system comprising:

an interface coupled to the vehicle element configured to establish a communication link with a home security system; and a processing circuit configured to receive home security data from the home security system upon operator request and to transmit control messages to the home security system, wherein the control messages are configured to enable and disable the home security system.

2. The system according to claim 1, further comprising an operator input device coupled to the processing circuit, wherein the processing circuit is configured to disable the home security system in response to operator input at the operator input device.

3. The system according to claim 2, wherein the processing circuit is configured to receive secure zone data representing a plurality of secured zones of the home in response to operator input at the operator input device.

4. The system according to claim 1, further comprising an operator input device, wherein the processing circuit and interface are configured to contact emergency officials in response to operator input at the operator input device.

5. The system according to claim 1, wherein the vehicle element is a visor, an overhead console or an instrument panel of an automotive vehicle.

6. The system according to claim 1, wherein the communication link is a wireless communication link.

7. The system according to claim 1, wherein the processing circuit is configured to receive audio and video data from the home security system.

8. The system according to claim 1, wherein the processing circuit is configured to provide the audio and video data to a DVD system in the vehicle.

9. The system according to claim 1, wherein the vehicle element is a vehicle interior element.

10. The system of claim 1, wherein the interface is configured to establish a short-range communication link with the home security system.

11. The system of claim 1, wherein the system is configured as a trainable transceiver.

12. A method of communicating home security data between a vehicle and a home, comprising:

transmitting a request for home security data from an electronic module coupled to a vehicle to a home security system;

receiving home security data from the home security system in response to the transmitted request; and providing the home security data to an operator interface; and transmitting a message to emergency personnel in response to operator actuation of an operator input device coupled to the electronic module.

13. The method of claim 12, wherein the electronic module is coupled to a visor or overhead console of the vehicle.

14. The method of claim 12, further comprising transmitting a control message from the electronic module to the home security system, wherein the control message is configured to enable and disable the home security system.

15. The method of claim 12, wherein the home security data includes zone data representative of a zone of the house and security data associated with zone data representing the state of security of the zone.

16. The method of claim 15, further comprising receiving a scroll command from the operator interface and providing zone data and security data for each of a plurality of zones as selected by the scroll command.

17. The method of claim 12, wherein the home security data includes video data representative of a video image of an area of the home, wherein the operator interface includes a display configured to display the video data to a vehicle occupant.

18. The method of claim 12, further comprising providing transmission format data representative of the transmission format of the home security system, wherein the transmitting and receiving steps use the transmission format data.

19. The method of claim 18, wherein the transmission format data includes a frequency and a data code.

20. The method of claim 12, wherein the steps of transmitting and receiving occur over a short-range communication link.

21. The method of claim 12, further comprising learning format data of the home security system.

22. An apparatus for communicating home security data between a vehicle and a home, the apparatus comprising:

means for receiving home security data from the home security system at an electronic module in the vehicle;

means for providing the home security data to an operator interface; and means for learning format data, the format data comprising a frequency of a system to be controlled.

23. The apparatus according to claim 22, further comprising:

means for transmitting a request for home security data from the electronic module in the vehicle to the home security system, wherein the home security data is received from the home security system in response to the transmitted request.

24. The apparatus according to claim 23, further comprising means for transmitting a control message from the electronic module to the home security system, wherein the control message is configured to enable and disable the home security system.

25. The apparatus according to claim 24, wherein the home security data includes video data representative of a video image of an area of the home, wherein the operator interface includes a display configured to display the video data to a vehicle occupant.

26. A system for communicating home security data between a vehicle having a vehicle element and a home having a home security system, the system comprising:

an interface coupled to the vehicle element configured to establish a communication link with the home security system; and a processing circuit configured to receive home security data from the home security system, wherein the processing circuit, during a training mode, is configured to learn format data, the format data comprising a frequency of a system to be controlled.

27. The system according to claim 26, wherein the format data includes a data code.

28. The system according to claim 26, wherein the system learns the format data by receiving a signal transmitted by the system to be controlled and learning the data format based on the received signal.

29. The system according to claim 26, wherein the system learns the format data by operator selection of one of a plurality of pre-stored or predetermined data formats stored in the system.

30. The system according to claim 26, wherein the system to be controlled is the home security system and the processing circuit is configured to learn the format data of the home security system.

* * * * *